US010603532B2

(12) United States Patent
Stubenrauch

(10) Patent No.: US 10,603,532 B2
(45) Date of Patent: Mar. 31, 2020

(54) FOAM-WATER SPRINKLER

(71) Applicant: Fabrik chemischer Präparate von Dr. Richard Sthamer GmbH & Co. KG, Hamburg (DE)

(72) Inventor: Jens Stubenrauch, Jena (DE)

(73) Assignee: Fabrik chemischer Praparate von Dr. Richard Sthamer GmbH & Co. KG, Hamburg (DE)

( * ) Notice: Subject to any disclaimer, the term of this patent is extended or adjusted under 35 U.S.C. 154(b) by 12 days.

(21) Appl. No.: 15/643,840

(22) Filed: Jul. 7, 2017

(65) Prior Publication Data

US 2018/0064974 A1 Mar. 8, 2018

(30) Foreign Application Priority Data

Jul. 7, 2016 (DE) ..... 10 2016 212 391

(51) Int. Cl.

| | |
|---|---|
| ***A62C 31/12*** | (2006.01) |
| ***A62C 37/08*** | (2006.01) |
| *B05B 15/16* | (2018.01) |
| *A62C 5/02* | (2006.01) |

(52) U.S. Cl.

CPC ..... *A62C 31/12* (2013.01); *A62C 37/08* (2013.01); *A62C 5/02* (2013.01); *B05B 15/16* (2018.02)

(58) Field of Classification Search

CPC ..... A62C 37/02; A62C 37/08; A62C 37/09; A62C 37/10; A62C 37/102; A62C 37/11; A62C 37/12; A62C 5/02; A62C 31/12; B05B 15/16; B05B 1/265

USPC ..... 239/288, 288.3, 288.5

See application file for complete search history.

(56) References Cited

U.S. PATENT DOCUMENTS

| | | | | |
|---|---|---|---|---|
| 3,797,746 | A * | 3/1974 | Gray | A62C 37/08 169/37 |
| 5,447,338 | A * | 9/1995 | Kikuchi | F16L 5/02 137/359 |
| 5,893,418 | A * | 4/1999 | Ponte | A62C 31/02 169/37 |
| 6,484,809 | B1 * | 11/2002 | Elder | A62C 31/28 169/37 |
| 2007/0256844 | A1 * | 11/2007 | Blasing | A62C 35/68 169/51 |
| 2009/0151962 | A1 * | 6/2009 | de Ris | A62C 35/68 169/37 |

(Continued)

FOREIGN PATENT DOCUMENTS

DE 19539991 C1 2/1997

*Primary Examiner* — Alexander M Valvis

(74) *Attorney, Agent, or Firm* — Alix, Yale & Ristas, LLP

(57) ABSTRACT

A cage for generating fire-fighting foam from fluid containing foaming agent released from a sprinkler may be constructed from woven screen or expanded lattice having screen openings having a diameter between 1 mm and 7 mm and/or lattice openings having a width between 1 and 7 mm and a length between 2 mm and 9 mm. The cage has dimensions which permit an intermediate space between a fluid exit opening and spray plate of the sprinkler to be surrounded radially with a height and a width: the height corresponds to at least 0.20 times the external diameter of the spray plate; the internal diameter of the cage, alternatively the non-circular minimum spacing between the opposite internal sides of the cage, at the level of the spray plate, corresponds to at least the external diameter of the spray plate.

20 Claims, 2 Drawing Sheets

(56) References Cited

U.S. PATENT DOCUMENTS

2010/0243283 A1* 9/2010 Green ..... A62C 31/02
169/56

* cited by examiner

FOAM-WATER SPRINKLER

BACKGROUND

The invention relates to a sprinkler having a cage for generating fire-fighting foam from a fire-fighting fluid (for example water) containing foaming agent for fighting fires.

Fire-fighting foam is composed substantially of air, water, and a foaming agent containing surfactant. In terms of the foaming agent containing surfactant, the fire-fighting foam in foams that contain fluorine surfactant ('AFFF' or 'A3F' foam fire-fighting agents) and fire-fighting foam that is free from fluorine surfactant can be differentiated, the different modes of action of which will be briefly explained hereunder.

In the use of AFFF foaming agents, the fluorine surfactants by virtue of the chemical structure thereof that differs from that of conventional hydrocarbon surfactants cause a vapour-tight aqueous liquid film of typically 10-30 μm in thickness between the burning surface and the foam. This water film that is caused by fluorine surfactant acts as a barrier to the exit of vapours of burnt material and suppresses any reigniting. By virtue of these properties, AFFF foaming agents are also referred to as 'film-forming foams', this being reflected in the acronym thereof of 'AFFF' or 'A3F' for 'Aqueous Film Forming Foam'. A further substantial advantage that is linked to the film formation lies in that the foam layer that is bearing on the film does not have to display any outstanding barrier function, that is to say that the fire-fighting foam needs to have only a minor expansion ratio or none at all. In practice, effective fire-fighting using AFFF foaming agents with an expansion ratio of less than 4, typically between 1.5 and 3.0, is therefore adequate, since the major fire-fighting effect is caused by the gas-tight liquid film on the burning surface that is caused by fluorine surfactant. These low expansion ratios mentioned above are achieved by using conventional sprinklers that are conceived for operating with water or AFFF fire-fighting agents. However, these conventional sprinklers by virtue of the construction mode thereof cannot achieve any higher expansion ratio. To this end, one must resort to special sprinklers that are technically complex, for example in the construction mode of a heavy-foam sprinkler such as disclosed in DE 195 39 991 C1, said special sprinklers being approximately 40% to 70% more expensive and are significantly more complex in terms of the construction than the conventional sprinklers.

Heavy-foam sprinklers of this type are installed in particular where AFFF fire-fighting foams by virtue of the damaging properties of the fluorine surfactant component (persistent, bio-accumulative, toxic) must not be used, or where conventional sprinklers that previously have been operated with AFFF fire-fighting foam have to be converted to heavy-foam sprinklers by virtue of the ban on fluorine surfactants. To this end, please refer to the application restrictions of guideline 2006/122/EG. Since fire-fighting foam that is free from fluorine surfactant lacks the film barrier on account of the absence of the fluorine surfactants, the necessary barrier function is thus assigned to substantially only the foam layer. However, the barrier function is only effective at an expansion ratio of 4 and above, at which point said foam is usually referred to as heavy foam, requiring the use of special heavy-foam sprinklers as mentioned above.

SUMMARY OF THE INVENTION

An object of the present disclosure is to solve the conflict of objectives as illustrated above, that is to say

- dispensing with fluorine surfactants in the fire-fighting agent, as desired, on the one hand,
- avoiding the use of, or the conversion of conventional sprinklers with an insufficient expansion ratio to technically more complex heavy-foam sprinklers, as desired, on the other hand, in as simple a manner as possible, preferably in the fashion of a 'universal solution' for conventional sprinklers with expansion ratios of less than 4, such that the replacement of conventional sprinklers by more expensive heavy-foam sprinklers (including the effort for removal and installation and the sealing issues associated therewith) can be avoided. The solution herein is effective preferably in the case of fire-fighting agents that contain fluorine surfactant as well as for fire-fighting agents that are free from fluorine surfactant. Providing sprinkers compatible with fire-fighting agents that are free from fluorine surfactant is of particular significance against the background of being permitted to use said sprinklers according to the intended use also in the case of a looming blanket ban on foam-based fire-fighting agents containing fluorine surfactant in the future.

This object is achieved by a cage having the features according to the appended independent claims, said cage complementing conventional sprinklers as mentioned above and permitting conventional sprinklers with an inadequate expansion ratio of typically less than 4 to be converted to heavy-foam sprinklers in a simple manner. Advantageous embodiments of the invention are disclosed in the dependent claims. In detail:

The cage according to the invention is a complementary part for a conventional sprinkler and serves for generating fire-fighting foam from a fire-fighting fluid containing foaming agent. The conventional sprinkler comprises a fire-fighting fluid exit opening, a spray plate, opposite the fire-fighting fluid exit opening in the axial direction, and sprays the fire-fighting fluid across the spray plate at an expansion ratio which without the cage according to the invention is significantly below that of heavy foam (the latter starting at an expansion ratio of 4). Umbrella sprinklers of this construction type mentioned in an exemplary manner include the Victaulic umbrella sprinkler V2704 (K80) and the Tyco umbrella sprinkler TY315 (K80). In the case of sprinklers of this conventional type, a cylindrical intermediate space that is formed between the base area (G) of the spray plate and the fire-fighting fluid exit opening can be defined, the diameter of said intermediate space corresponding to the external diameter ($d_1$) of the spray plate, and the height ($h_1$) of said intermediate space, measured from the centre of the base area (G), corresponding to the spacing from the fire-fighting fluid exit opening. According to the invention, the cage that is provided for sprinklers of this construction type has screen openings having a diameter between 1.00 mm and 7.00 mm and/or lattice openings having a width between 1.00 and 7.00 mm and a length between 2.00 mm and 9.00 mm, preferably formed by an expanded lattice, said screen openings and lattice openings permitting the fire-fighting fluid flow passing through the cage, in conjunction with the specific dimensions of said cage, to be upgraded to form heavy foam. An expanded metal (non-deburred) is particularly suitable as the expanded cage, because the sharp edges of the material cause particularly good foaming. The dimensions which are also adapted to the sprinkler permit the cage according to the invention to encase the sprinkler intermediate space mentioned above, wherein the height ($h_2$) of the cage corresponds to at least 0.20 times the external diameter ($d_1$) of the spray plate.

Furthermore, the internal diameter ($d_2$) of the cage, alternatively the non-circular minimum spacing between the opposite internal sides of the cage, at the level of the spray plate, corresponds to at least the external diameter ($d_1$) of the spray plate in the installed state. To the extent that the cage according to the invention by way of the internal side thereof does not bear directly on the spray plate in a radial manner, that is to say that a clear dimension (b) can be defined as the intermediate space, according to one preferred embodiment of the invention this clear dimension (radial space) between the internal side of the cage (1) and the spray plate (4), at the level of the spray plate, in an encircling manner is between 0.10 to 3.00 times, preferably between 0.50 to 2.00 times, further preferably between 0.75 to 1.50 times, most preferably between 1.00 and 1.25 times the external diameter ($d_1$) of the spray plate. The invention has recognized that the radial spacing between the cage and the spray plate has a direct influence on the expansion ratio and thus can be advantageously variable. Comparative tests have demonstrated that the expansion ratio increases as the spacing increases. Particularly advantageous herein is spacing of 0.75 to 1.50 times the external diameter ($d_1$) of the spray plate, at which particularly advantageous expansion ratios of 4-7 are set and the foam is still sufficiently homogenous (by contrast to foam having higher expansion ratios caused by a larger spacing).

The cage advantageously has a height which permits the majority of the fire-fighting fluid that has been deflected by the spray plate to be directed through the cage according to the invention. This height ($h_2$) of the cage is advantageously at least 0.50 times, preferably 0.75 times, furthermore preferably 1.00 times the external diameter ($d_1$) of the spray plate, and can correspond to the height ($h_1$) of the sprinkler intermediate space, for example. Proceeding from the height ($h_1$) of the sprinkler intermediate space, the height ($h_2$) of the cage according to one preferred embodiment can be defined such that said height ($h_2$) corresponds to the height ($h_1$) of the sprinkler intermediate space, preferably corresponds to less than 0.75 times the height ($h_1$) of the sprinkler intermediate space, furthermore preferably corresponds to less than 0.50 times the height ($h_1$) of the sprinkler intermediate space.

The cage according to the invention can have any suitable shape, for example the shape of a hollow cylinder, of a hollow cone, of a hollow truncated cone, of a hollow pyramid, of a hollow sphere, of a hollow polygon such as a pentagon, hexagon or octagon, or a combination of these shapes, wherein the hollow cylindrical shape is particularly preferred. Furthermore, the cage can extend in a tapered manner in the axial direction beyond that region of said cage that encases the intermediate space, and for example open into an opening that has an internal diameter which is larger than the external diameter ($d_1$) of the spray plate. An opening with an internal diameter larger than the external diameter ($d_1$) of the spray plate is of particular advantage in order to enable small parts of the triggering elements that are typically used (bursting elements with a liquid, soldered strut, etc.) to drop out of the sprinkler in an unencumbered manner, said small parts otherwise being caught in the cage and compromising the screen or lattice openings in the intended functioning thereof as expansion elements. According to one particularly preferred embodiment, the cage is shaped as a hollow cylinder, the (upper) end of the hollow cylinder that faces the fire-fighting fluid exit opening being open across the entire diameter area, while the opposite end at the level of the spray plate tapers in an axial manner and defines an opening below the spray plate.

According to one preferred embodiment of the invention, the cage lattice openings are non-circular and have a width between 2.00 mm and 6.00 mm and a length between 3.00 mm and 8.00 mm, preferably a width between 2.50 mm and 4.50 mm and a length between 5.00 mm and 7.00 mm. Furthermore, the cage lattice can advantageously be an expanded lattice having a mesh width between 2.50 mm and 4.50 mm, a mesh length of 5.00 mm to 7.00 mm and a thickness of 0.40 mm to 0.80 mm, preferably a mesh width of 3.50 mm, a mesh length of 6.00 mm, and a thickness of 0.60 mm. According to one further preferred embodiment of the invention, the cage may be constructed of screen having screen openings having a minimum diameter of 1.50 mm to 2.50 mm, preferably 1.75 mm to 2.25 mm, particularly preferably of 2.00 mm. The cage is preferably made from metal, for example steel, and particularly preferably from stainless steel (for example V2A stainless steel).

According to one preferred embodiment of the invention, the cage furthermore has a mounting for fastening the cage to the sprinkler. This mounting can be configured as a plurality of retaining arms, for example, which fasten the cage to the base of the sprinkler in the region of the fire-fighting fluid exit opening on the sprinkler body or on the connection thread of said sprinkler disposed thereabove, for example by way of a plurality (for example 2, 3, 4, 5, or 6) clamping feet. The retaining arms or clamping feet, respectively, for easier crumpling can be provided with predetermined breaking points, in order for positioning of the cage in relation to the sprinkler to be able to be performed in a simple manner depending on the sprinkler and the installation conditions. In order for the retaining arms or the clamping feet, respectively, to have a secure footing on the sprinkler, said retaining arms or clamping feet, respectively, can additionally be secured by way of a securing element, for example a tying element (cable tie, metal strap, etc.) that encompasses the retaining arms or clamping feet in a radial manner.

As has been mentioned at the outset, the cage according to the invention is particularly suitable for conventional umbrella sprinklers which can be upgraded or retrofitted, respectively, with the aid of the cage in order to achieve higher expansion ratios. This applies in particular to foaming-agent containing fire-fighting fluids that are free from fluorine surfactant, in the case of which the advantage of the cage becomes particularly pertinent. In the case of these conventional sprinklers, fire-fighting foam with an expansion ratio of 3 to 9, preferably of 4-8, furthermore preferably of 4.5 to 7, particularly preferably of 5-6, can preferably be generated by way of the cage according to the invention.

A set of parts that can be used as a conversion kit or a functional group which apart from the sprinkler comprises the above-described cage according to the disclosure is furthermore the subject matter of the appended claims. The sprinkler per se is known from the prior art and comprises a fire-fighting fluid exit opening and a spray plate, opposite the fire-fighting fluid exit opening in the axial direction, as has already been described in more detail above in the context of the cage. According to one preferred embodiment of the invention, the arrangement of the set or of the functional group is such the cage surrounds the intermediate space that is formed on the base area (G) of the spray plate such that the base area (G) of the spray plate is aligned with the lower side of the cage that faces away from the fire-fighting fluid exit opening.

The use of the above-described cage, set, or the functional group according to the invention for generating fire-fighting foam from a fire-fighting fluid containing foaming agent, and a method for generating fire-fighting foam from a fire-fighting fluid containing foaming agent are furthermore the subject matter of the invention. The method comprises the steps of providing a fire-fighting fluid containing foaming agent, and a functional group as has been explained above, and conveying the fire-fighting fluid that has been deflected out of the fire-fighting fluid exit opening and by the spray plate through the cage according to the invention, wherein the fire-fighting foam is created from the fire-fighting fluid as the fire-fighting fluid passes through the cage.

The present invention will be described in more detail hereunder by means of the appended examples and figures.

EXAMPLE 1

The following sprinklers without (FIG. 2A) or with a cage (FIGS. 2B, 2C and 2D) according to the invention, respectively, and a reference heavy-foam sprinkler (FIG. 2E) were tested in a test series, and the expansion ratios were measured according to DIN EN 1568. Testing was carried out on three different fire-fighting fluids that are free from fluorine surfactant, such as specified in the table hereunder, at different pressures (1 bar, 2 bar, and 3 bar). Since no significant differences can be established at the different pressures examined, the table hereunder lists the expansion ratios measured at a pressure of 2 bar.

FIG. 2A (prior art)—Tyco umbrella sprinkler (upright) TY315 (K80) without cage (reference);

FIG. 2B—Victaulic umbrella sprinkler (upright) V2704 (K80) having the annular cage according to the invention bearing directly on the external edge of the spray plate, said annular cage being made from expanded metal (V2A) stainless steel and having a mesh width of 3.5 mm, a mesh length of 6 mm, and a sheet-metal thickness of 0.6 mm;

FIG. 2C—Victaulic umbrella sprinkler (upright) V2704 (K80) having the annular cage according to the invention with a circumferential clear dimension of 4 cm in relation to the external edge of the spray plate, said annular cage being made from expanded metal (V2A) stainless steel and having a mesh width of 3.5 mm, a mesh length of 6 mm, and a sheet-metal thickness of 0.6 mm;

FIG. 2D—Jomos umbrella sprinkler (suspended) (K80) having the cage according to the invention in the form of a screen of V2A stainless steel, and having a screen opening diameter of 2 mm and being spaced apart from the external edge of the spray plate at the level of the spray plate in an encircling manner by 3.5 cm;

FIG. 2E (prior art)—Minimax heavy-foam sprinkler (suspended) MX5 (K80) of a construction type that is analogous to that described in DE 195 39 991 C1 and in technical terms is fundamentally different from that of the present invention. This foam water sprinkler, behind the sprinkler in the flow direction of the fire-fighting foam and along the sprinkler longitudinal axis, has a spray plate having openings and thereafter a foam screen. The fire-fighting foam in a free jet from the sprinkler exit opening impacts the spray plate. Part of the fire-fighting foam herein is distributed by the spray plate, while another part of the fire-fighting foam passes through the spray plate openings and by the downstream foam screen is upgraded to have large foam bubbles.

| | Expansion ratio for | | | | |
|---|---|---|---|---|---|
| Fire-fighting fluid | A | B | C | D | E |
| Moussol-APS 1/3 F-0 #3471 | 2.11 | 4.02 | 8.69 | 6.97 | 4.97 |
| Sthamex 3% F-15 #9348 | 2.40 | 4.80 | 10.58 | 7.37 | 6.35 |
| Silvara 1% F-15 | 2.36 | 3.72 | 8.25 | 6.40 | 5.32 |

As expected, the conventional sprinkler (FIG. 2A) per se, that is to say without the cage according to the invention, did not display an adequate expansion. The expansion ratios are significantly below those of heavy foam that commence at approximately 4. A correspondingly adequate expansion is however achieved when using the cage according to the invention (FIGS. 2B, 2C and 2D) which enables the generation of a heavy foam having expansion values that are analogous to those of the reference heavy-foam sprinkler (FIG. 2E) that is different in terms of construction technology. The test series likewise demonstrates that three different fire-fighting fluids that are free from fluorine surfactant and are conceived for dissimilar foaming behaviours in the use of the cage according to the invention display expansion ratios that hardly deviate from one another.

BRIEF DESCRIPTION OF THE DRAWINGS

The invention is explained below with reference to the attached drawings. In the drawings.

DETAILED DESCRIPTION

Figure 1:
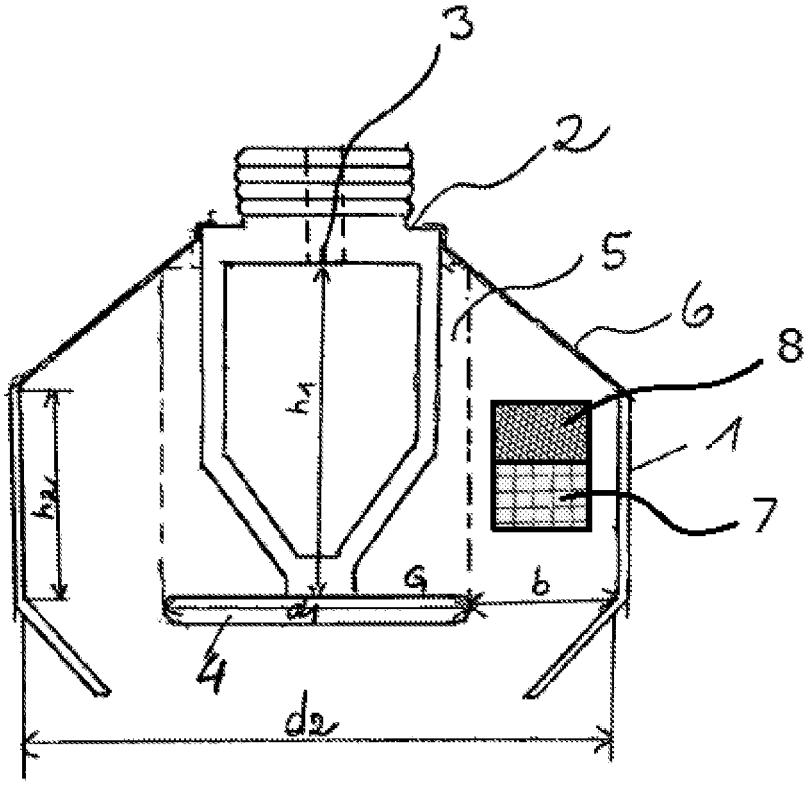
FIG. 1 is a side view, partially in section of a sprinkler in functional conjunction with one embodiment of a cage according to aspects of the disclosure.
Figure 2A:
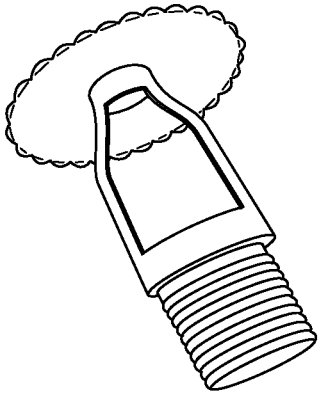
FIG. 2A PRIOR ART
FIG. 2A illustrates a prior art Tyco umbrella sprinkler.
Figure 2B:
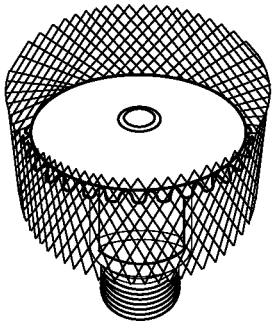
FIG. 2B is a perspective view from below of an umbrella sprinkler equipped with an exemplary embodiment of a cage according to aspects of the disclosure.
Figure 2C:
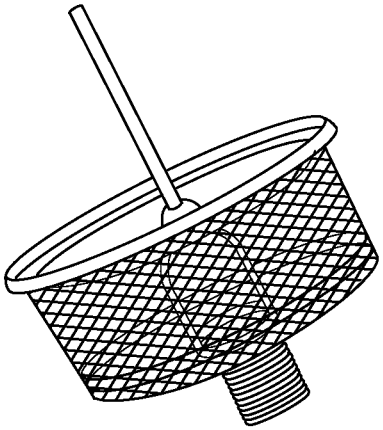
FIG. 2C is a side perspective view of an umbrella sprinkler equipped with an exemplary embodiment of a cage according to aspects of the disclosure.
Figure 2D:
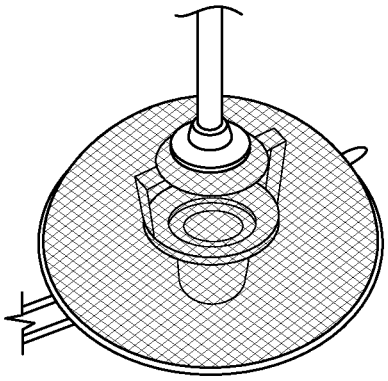
FIG. 2D is a perspective view from above of an umbrella sprinkler equipped with an exemplary embodiment of a cage according to aspects of the disclosure.
Figure 2E:
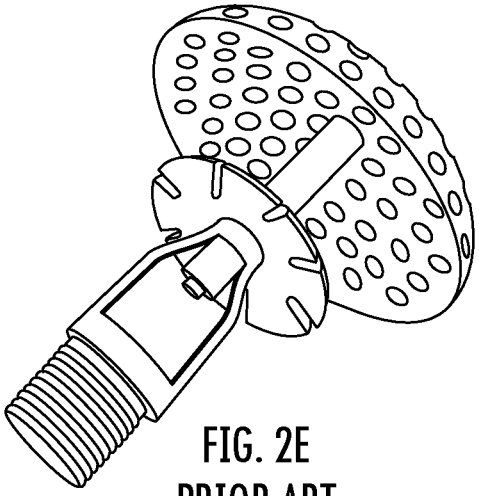
FIG. 2E PRIOR ART
FIG. 2E is a side view of a prior art Minimax heavy-foam sprinkler against which the performance the embodiments of FIGS. 2B-2C is compared.

FIG. 1 shows the construction of a conventional umbrella sprinkler 2 in combination with the cage 1 having screen openings 8 and/or lattice openings 7 according to the invention. The sprinkler 2 on the head part thereof has an external thread for screw-fitting into a respective wall, floor or ceiling installation, and at the opposite end has a fire-fighting fluid exit opening 3. The head part of the sprinkler 3 rests on a bridge which comprises two supports that in a laterally downward manner converge to form a carrier bracket and transition into a carrier bracket, a spray plate 4 having a diameter d1 and a base area G being moulded on the underside thereof at a spacing h1 from the fire-fighting fluid exit opening 3. The cage 1 has an upper cylindrical region having a diameter d2, and a lower conical region, wherein the conical region defines an opening at the bottom of the cage 1. The upper cylindrical region of the cage 1 having a height h2 terminates at the level of the spray plate 4 and is radially spaced apart from the outside diameter (d1) of the spray plate 4 at a clear dimension b. Clear dimension b is not limited to a circular or annular space and may have other forms depending upon the configuration of the cage 1. The cage comprises the intermediate space 5 that is illustrated by means of (dashed) lines between the spray plate 4 and the fire-fighting fluid exit openings 3. The cage 1 is clamp-fitted to the head part of the sprinkler 2 by way of retaining arms 6. FIG. 2A shows the Tyco umbrella sprinkler (upright) TY315 (K80) without cage (reference);

FIG. 2B shows the Victaulic umbrella sprinkler (upright) V2704 (K80) having the annular cage according to the invention bearing directly on the external edge of the spray plate, said annular cage being made from expanded metal (V2A) stainless steel and having a mesh width of 3.5 mm, a mesh length of 6 mm, and a sheet-metal thickness of 0.6 mm;

FIG. 2C shows the Victaulic umbrella sprinkler (upright) V2704 (K80) having the annular cage according to the invention with a circumferential clear dimension of 4 cm in relation to the external edge of the spray plate, said annular cage being made from expanded metal (V2A) stainless steel and having a mesh width of 3.5 mm, a mesh length of 6 mm, and a sheet-metal thickness of 0.6 mm;

FIG. 2D shows the Jomos umbrella sprinkler (suspended) (K80) having the cage according to the invention in the form of a woven screen of V2A stainless steel having a screen opening diameter of 2 mm and being spaced apart from the external edge of the spray plate at the level of the spray plate in an encircling manner by 3.5 cm;

FIG. 2E shows the Minimax heavy-foam sprinkler (suspended) MX5 (K80) of a construction type that is analogous to that described in DE 195 39 991 C1 and in technical terms is fundamentally different from that of the present invention.

What is claimed:

1. A cage (1) generating fire-fighting foam from a fire-fighting fluid containing foaming agent for a sprinkler (2) comprising:

a fire-fighting fluid exit opening (3);

a spray plate (4), opposite the fire-fighting fluid exit opening (3) and spaced from the fire-fighting fluid exit opening (3) in an axial direction, said spray plate (4) having a base area (G) and an external diameter ($d_1$), and a cylindrical intermediate space (5) that is formed between the base area (G) of the spray plate (4) and the fire-fighting fluid exit opening (3), a diameter of said cylindrical intermediate space (5) corresponding to the external diameter ($d_1$) of the spray plate (4) and a height ($h_1$) of said cylindrical intermediate space (5), measured from the centre of the base area (G), corresponding to the spacing of the spray plate (4) from the fire-fighting fluid exit opening (3), wherein the cage (1)

(a) has screen openings (8) having a diameter between 1.00 mm and 7.00 mm and/or lattice openings (7) having a width between 1.00 and 7.00 mm and a length between 2.00 mm and 9.00 mm, (b) has dimensions which permit said cylindrical intermediate space (5) to be encased radially with a height ($h_2$) and a width ($d_2$) as follows:

the height ($h_2$) of the cage (1) corresponds to at least 0.20 times the external diameter ($d_1$) of the spray plate (4), a lower edge of the cage (1) extending to the spray plate (4) or axially beyond the spacing of the spray plate (4) from the fire-fighting fluid exit opening (3), and the internal diameter ($d_2$) of the cage (1) at a level of the spray plate (4) in the axial direction, corresponds to at least the external diameter ($d_1$) of the spray plate (4), wherein, said fire-fighting fluid is deflected by the spray plate (4) and directed through the screen openings (8) or lattice openings (7) to create fire-fighting foam.

2. The cage (1) according to claim 1, wherein a radial clearance (b) between an internal side of the cage (1) and the spray plate (4), at the level of the spray plate, is between 0.10 to 3.00 times the external diameter ($d_1$) of the spray plate (4).

3. The cage (1) according to claim 1, wherein the height ($h_2$) of the cage (1) is between 0.5 to 1.00 times the external diameter ($d_1$) of the spray plate (4).

4. The cage (1) according to claim 1, wherein the height ($h_2$) of the cage (1) is between 0.75 times to 0.50 times the height ($h_1$) of the cylindrical intermediate space (5).

5. The cage (1) according to claim 1, wherein the cage (1) is a hollow cylinder, a hollow cone, a hollow truncated cone, a hollow pyramid, a hollow polygon, a hollow sphere, or a combination of said shapes.

6. The cage (1) according to claim 1, wherein the cage (1) tapers in the axial direction beyond said spray plate (4) if the lower edge of the cage extends axially beyond the spacing of the spray plate (4) from the fire-fighting fluid exit opening (3).

7. The cage (1) according to claim 6, wherein the region that tapers in the axial direction defines an opening having an internal diameter that is larger than the external diameter ($d_1$) of the spray plate (4).

8. The cage (1) according to claim 1, wherein the lattice openings (7) have a width between 2.00 mm and 6.00 mm.

9. The cage (1) according to claim 1, wherein the cage is constructed of lattice having a mesh width between 2.50 mm and 4.50 mm, a mesh length of between 5.00 mm and 7.00 mm, and a thickness of 0.40 mm to 0.80 mm.

10. The cage (1) according to claim 1, wherein the cage is constructed of woven screen having screen openings (8) with a diameter of 1.50 mm to 2.50 mm.

11. The cage (1) according to claim 1, wherein the cage (1) is made from metal.

12. The cage (1) according to claim 1, wherein the cage (1) has a mounting (6) for fastening the cage (1) to the sprinkler (2).

13. The cage (1) according to claim 1, wherein the fire-fighting fluid does not comprise any foaming agent containing fluorine surfactants.

14. The cage (1) according to claim 1, wherein the fire-fighting foam that is generated by the cage has an expansion ratio of 3 to 9.

15. An assembly generating fire-fighting foam from a fire-fighting fluid containing foaming agent comprising the cage (1) according to claim 1.

16. The assembly according to claim 15, wherein the cage (1) surrounds the cylindrical intermediate space (5) that is formed on the base area (G) of the spray plate (4) such that the base area (G) of the spray plate (4) is axially aligned with a lower side of the cage (1) that faces away from the fire-fighting fluid exit opening (3).

17. The cage (1) according to claim 1, wherein said cage (1) has an inside diameter ($d_2$) at the level of the spray plate (4) that is greater than the external diameter ($d_1$) of the spray plate (4), thereby defining a radial clearance (b) between an internal side of the cage (1) and the spray plate (4), at the level of the spray plate.

18. The cage (1) according to claim 17, wherein said cage (1) is conical, cylindrical, or spherical and said radial clearance (b) is an annular gap.

19. The cage (1) according to claim 17, wherein said cage (1) has a non-circular configuration and said radial clearance (b) is non-circular.

20. A method generating fire-fighting foam from a fire-fighting fluid containing foaming agent, said method comprising the following steps:

(i) providing a fire-fighting fluid containing foaming agent;

(ii) providing a sprinkler (2) for spraying said fire-fighting fluid, said sprinkler having a fire-fighting fluid exit opening (3), a spray plate (4), opposite the fire-fighting fluid exit opening (3) in the axial direction, having a base area (G) and an external diameter ($d_1$), a cylindrical intermediate space (5) that is formed between the base area (G) of the spray plate (4) and the fire-fighting fluid exit opening (3), a diameter of said cylindrical intermediate space (5) corresponding to the external diameter ($d_1$) of the spray plate (4);

(iii) providing a cage (1) comprising (a) screen openings (8) having a diameter between 1.00 mm and 7.00 mm and/or lattice openings (7) having a width between 1.00 and 7.00 mm and a length between 2.00 mm and 9.00 mm, (b) dimensions which permit said cylindrical intermediate space (5) to be radially surrounded with a height ($h_2$) and a width ($d_2$) as follows:

the height ($h_2$) of the cage (1) corresponds to at least 0.20 times the external diameter ($d_1$) of the spray plate (4), a lower edge of the cage (1) extending to the spray plate (4) or axially beyond the cylindrical intermediate space (5), and the internal diameter ($d_2$) of the cage (1), at the lower edge of the spray plate (4), corresponds to at least the external diameter ($d_1$) of the spray plate (4); and (iv) deflecting the fire-fighting fluid via the spray plate (4) and directing the fire-fighting fluid through the screen openings (8) or lattice openings (7) to create fire-fighting foam.

* * * * *